US008684195B1

(12) United States Patent
Caruso

(10) Patent No.: US 8,684,195 B1
(45) Date of Patent: Apr. 1, 2014

(54) WALL MOUNTED STORAGE SYSTEM

(71) Applicant: Vincenzo Caruso, Clinton Township, MI (US)

(72) Inventor: Vincenzo Caruso, Clinton Township, MI (US)

( * ) Notice: Subject to any disclaimer, the term of this patent is extended or adjusted under 35 U.S.C. 154(b) by 0 days.

(21) Appl. No.: 13/729,422

(22) Filed: Dec. 28, 2012

(51) Int. Cl.
*A47F 5/08* (2006.01)

(52) U.S. Cl.
USPC ..... 211/90.01; 211/87.01; 211/94.01

(58) Field of Classification Search
USPC ..... 312/245; 211/90.02, 90.04, 94.01, 211/87.01, 103, 90.01, 189, 175; 108/152; 248/225.51, 225.2, 225.21, 222.11, 248/225.11, 214, 215, 216.1, 227.4, 250, 248/501, 500; 52/36.4
See application file for complete search history.

(56) References Cited

U.S. PATENT DOCUMENTS 4,344,660 A * 8/1982 Molnar et al. ..... 312/249.13
4,457,249 A * 7/1984 Disen ..... 114/88
4,711,419 A * 12/1987 Polosky ..... 248/225.21
4,928,833 A 5/1990 Huizenga
5,050,832 A * 9/1991 Lee et al. ..... 248/225.11
5,076,651 A * 12/1991 White ..... 312/265.3
5,135,194 A * 8/1992 Laughon et al. ..... 248/243
5,191,986 A 3/1993 Huizenga
5,586,594 A * 12/1996 Shapoff ..... 160/135
5,718,493 A * 2/1998 Nikolai ..... 312/245
5,819,958 A * 10/1998 Dement ..... 211/90.01
5,964,438 A * 10/1999 Camilleri ..... 248/225.21
2003/0006681 A1* 1/2003 Herron et al. ..... 312/245
2006/0091271 A1* 5/2006 Nowak ..... 248/225.21
2006/0243688 A1* 11/2006 Gilcrest et al. ..... 211/87.01
2007/0089683 A1* 4/2007 Roberts et al. ..... 119/477
2009/0145867 A1* 6/2009 Apgood et al. ..... 211/94.01
2012/0210667 A1* 8/2012 Daniocek et al. ..... 52/588.1

* cited by examiner

*Primary Examiner* — Darnell Jayne
*Assistant Examiner* — Hiwot Tefera
(74) *Attorney, Agent, or Firm* — Gifford, Krass, Sprinkle, Anderson & Citkowski, P.C.

(57) ABSTRACT

A wall mounted storage system has a track, a plurality of vertical panels, a plurality of plugs and a plurality of shelves. The track is mounted to a wall for supporting the vertical panels. The shelves and panels form compartments. Each vertical panel has a cut out which matches the configuration of the track. The cut out has a front radiused section and a rear flat section. The track has a corresponding front radiused edge and rear seat. The cut out mates with the track at the radiused and flat sections. An opening is provided between the bottom of the track and the bottom of the cut out. The plug fits within this opening to prevent the vertical panel from separating from the track after the panel is attached to the track. The front bottom edges of the vertical panels are protected by bottom protectors.

12 Claims, 8 Drawing Sheets

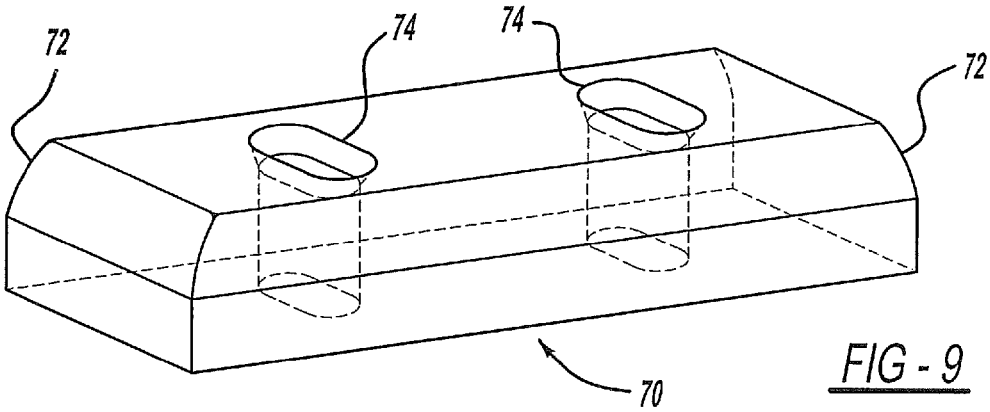
FIG - 9
FIG - 10
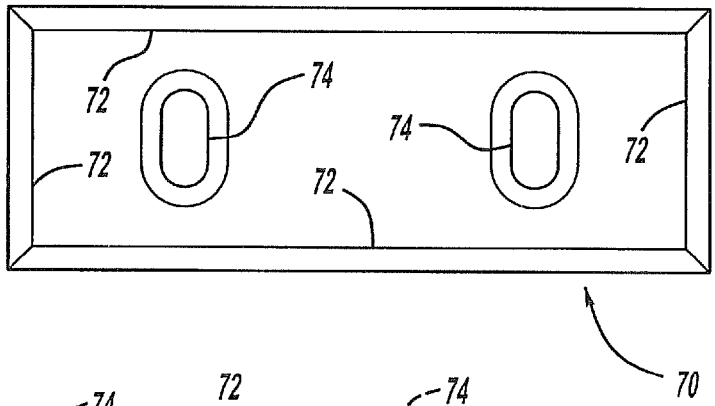
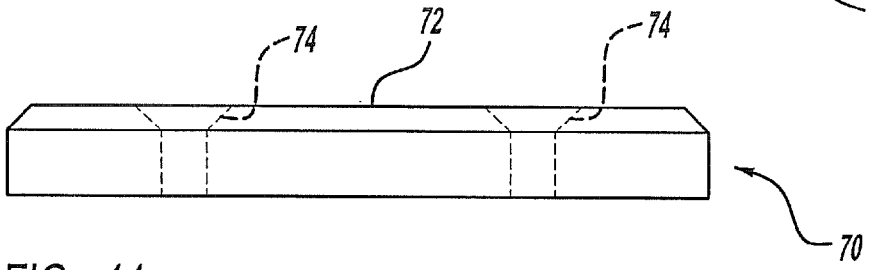
FIG - 11
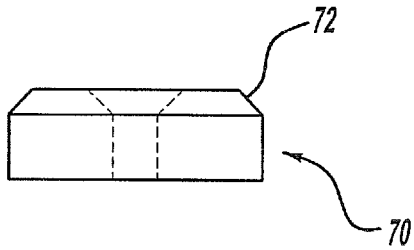
FIG - 12

WALL MOUNTED STORAGE SYSTEM

BACKGROUND

Wall mounted storage systems are often built into residential and commercial buildings. They provide a space savings means for storing various types of items, such as clothing and shoes.

A common type of wall mounted storage system is comprised of a track, a plurality of vertical panels and a plurality of shelves. The track is horizontally oriented and secured to a wall in a location such as a closet. The vertical panels are adapted to engage with the mounted track such that the vertical panels are stabilized in a vertical orientation. The shelves are horizontally oriented and attached to pairs of vertical panels to form storage compartments.

A number of problems are associated with current state-of-the-art wall mounted storage systems. The track is often unable to support significant loading. It tends to pull away from the wall to which it is attached under loading. Also, commonly used tracks have a tendency to bend and deform at their upper edges where they engage with the vertical panels.

The vertical panels engage with the track at cutouts within the vertical panels. Often, the vertical panel cutouts are misaligned with the track. This causes the vertical panels to be not as securely attached to the track as intended by the panel/track designer. As a result, the panels can be unintentionally disengaged from the track when the panels are bumped. Further, the track and the track engaging cutouts within the vertical panels may be damaged because of the cut out/track misalignment.

In many wall mounted storage systems the vertical panels do not rest upon a floor. Instead, the bottom edges of the vertical panels are positioned above floor level. The front lower corner sections of the vertical panels are exposed. They may be easily damaged by a person or object, such as a vacuum cleaner, unintentionally striking a corner section. Such contact between a person and a vertical panel lower corner may injure the person. Such contact between an object, such as an item of clothing, and a vertical panel corner may damage the object.

The wall mounted storage system described herein provides relief from the aforesaid problems associated with currently available wall mounted storage systems.

SUMMARY

A wall mounted storage system is comprised of a track, a plurality of vertical panels and a plurality of plugs. The track is horizontally oriented and mounted to a wall. The track has a front face, a rear face, a bottom surface and a top surface. The top surface of the track slopes downward from the front face of the track toward the rear face of the track.

Each vertical panel has a top section, a bottom section, a front edge, a rear edge and a cut out. The vertical panels are intended to form sidewalls of storage compartments formed within the wall mounted storage system. Each storage compartment is formed by two vertical panels and two shelves.

Each cut out is positioned within the top section of its respective vertical panel. The cutout extends through the rear edge of the vertical panel. The length of the cutout is configured to allow the vertical panel to slide over the track when the vertical panel is being engaged with the track. This process involves moving the cut out at the rear edge of the vertical panel from the front face of the track toward the rear face of the track in order to install the vertical panel onto the track. The length of the cut out is further configured such that a plug opening is provided between the bottom surface of the track and the bottom surface of the cut out when the cut out is engaged with the track. Each vertical panel is attached to the track by engaging the cut out of that vertical panel with the track.

The plug is sized and shaped to snugly fit into the opening between the bottom surface of the track and the bottom surface of a vertical panel attached to the track. The plug is inserted into this opening to prevent the vertical panel from lifting off of the track.

The top surface of the track has an upper front edge and an upper rear edge. Preferably, the upper rear edge of the track has a longitudinally extending horizontally oriented flat seat. The seat is positioned below the front edge of the track such that the top surface of the track slopes downward from the front face of the track toward the rear face of the track. The front upper portion of the cut out is configured to fit the front edge of the track. The rear upper portion of the cut out is configured to have a flat surface adapted to contact the seat of the track while the front upper portion of the cut out contacts the front edge of the track.

The body of the track should be adapted to support the entire top surface of the track. In other words, the body of the track should be configured so that the body will not tend to bend when the track is loaded by a vertical panel supporting its own load. The body of the track should have sufficient vertical width to allow the track to be secured to a wall stud by at least two fasteners. The term of vertical width refers to the vertical dimension of the track when it is attached to a wall.

DRAWINGS

These and other features, aspects, and advantages of the present invention will become better understood with regard to the following description, appended claims, and accompanying drawings where:

FIG. 9 is a perspective view of a bottom protector.

FIG. 10 is a top view of the bottom protector of FIG. 9.

FIG. 11 is a side elevation view of the bottom protector of FIG. 9.

FIG. 12 is a front elevation view of the bottom protector of FIG. 9.

DESCRIPTION

Figure 1:
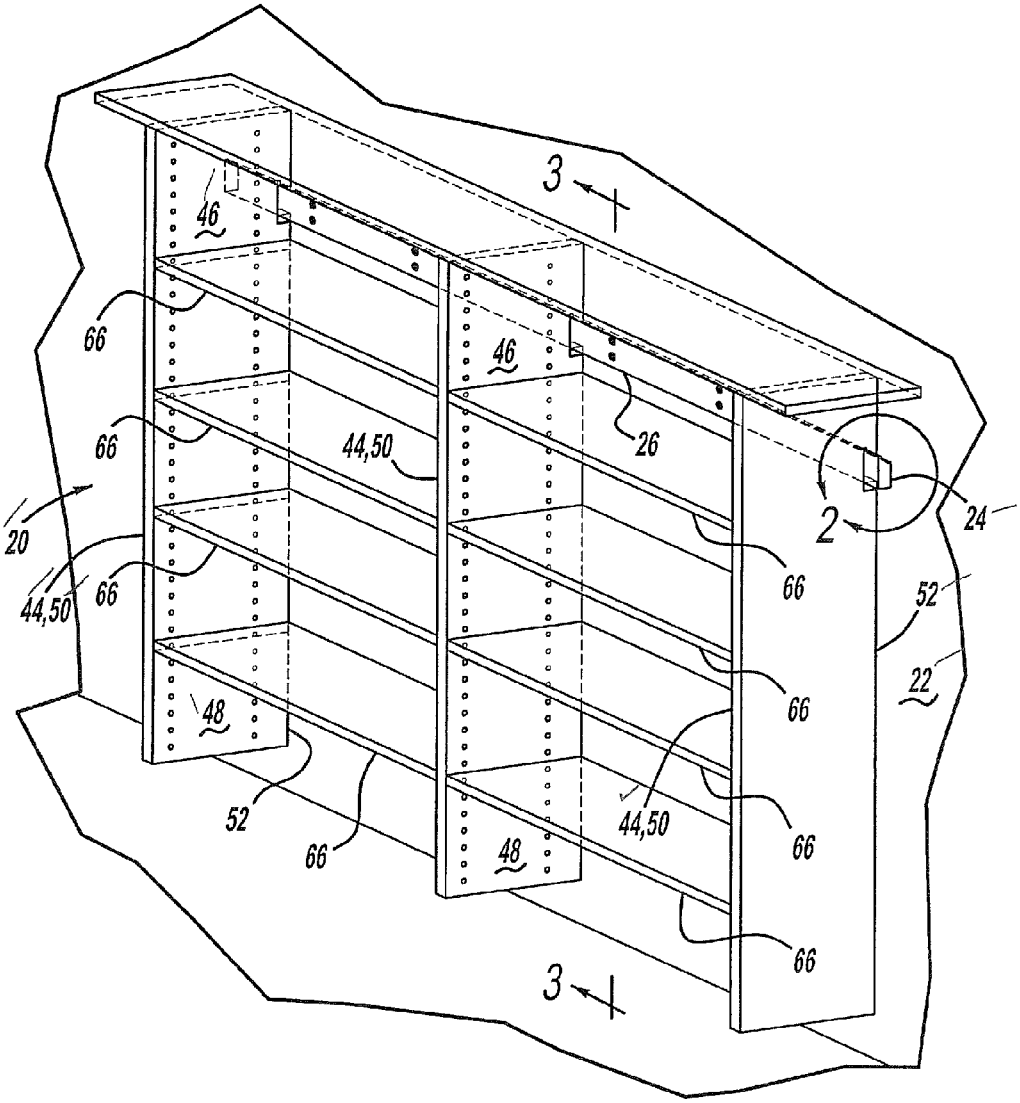
FIG. 1 is a perspective view of a wall mounted storage system showing the track, vertical panels and cutouts within the vertical panels described herein.

The preferred embodiment of a wall mounted storage system 20 is comprised of a track 24, a plurality of vertical panels 44, a plug 64 and a plurality of shelves 66.

The track 24 may be fabricated from a piece of wood having a 3 inch width and a ¾" thickness. This width will allow the track to be screwed or nailed to a single wall stud 23 in two locations. The track 24 should be so fastened to multiple wall studs 23. This will ultimately provide a very stable and secure base upon which the vertical panels 44 may be hung. It should be understood that the width and thickness dimensions of the track 24 may vary considerably from one storage system 20 installation to another and that the storage system 20 described herein is not limited to any particular width and thickness of the track 24.

Figure 2:
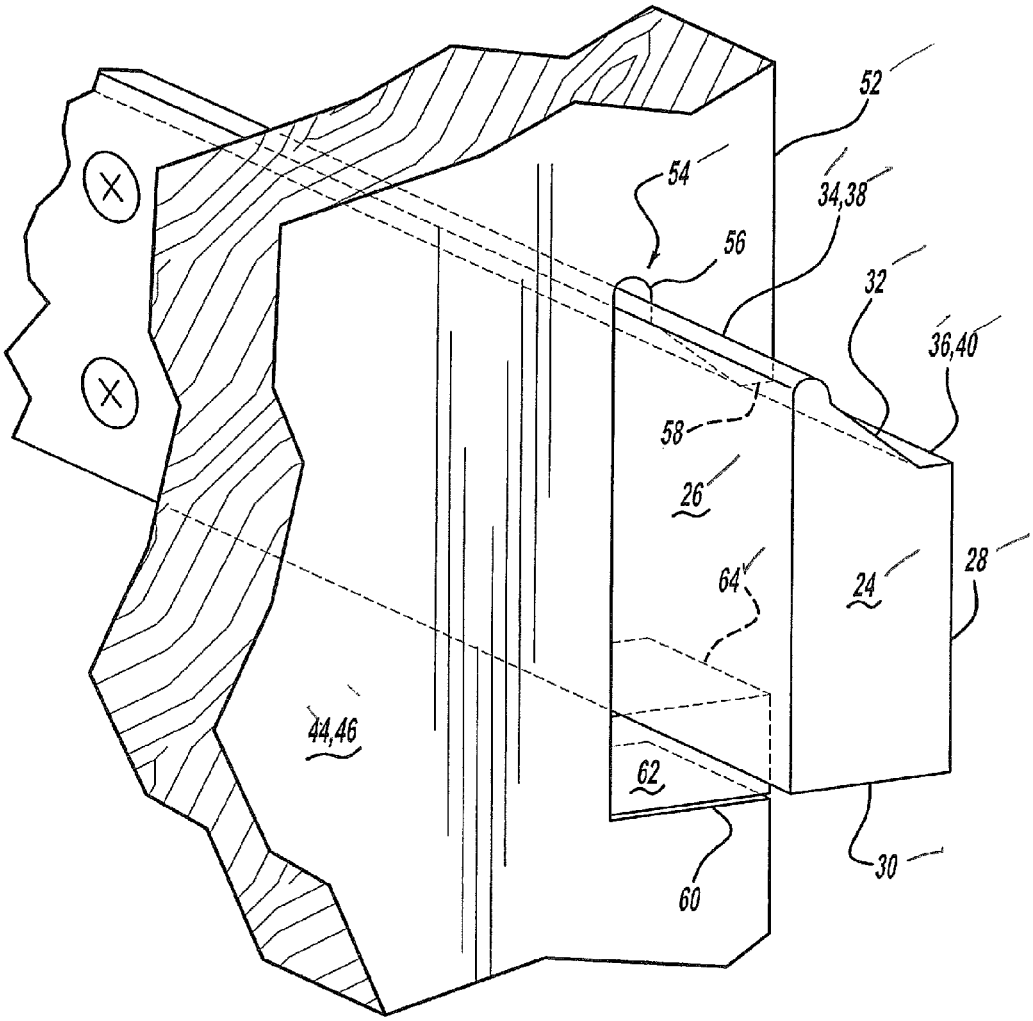
FIG. 2 is a broken away perspective view of the wall mounted storage system of FIG. 1, showing the configuration of the track, the configuration of the cut out within a vertical panel and the engagement of the cut out of the vertical panel with the track.
Figure 3:
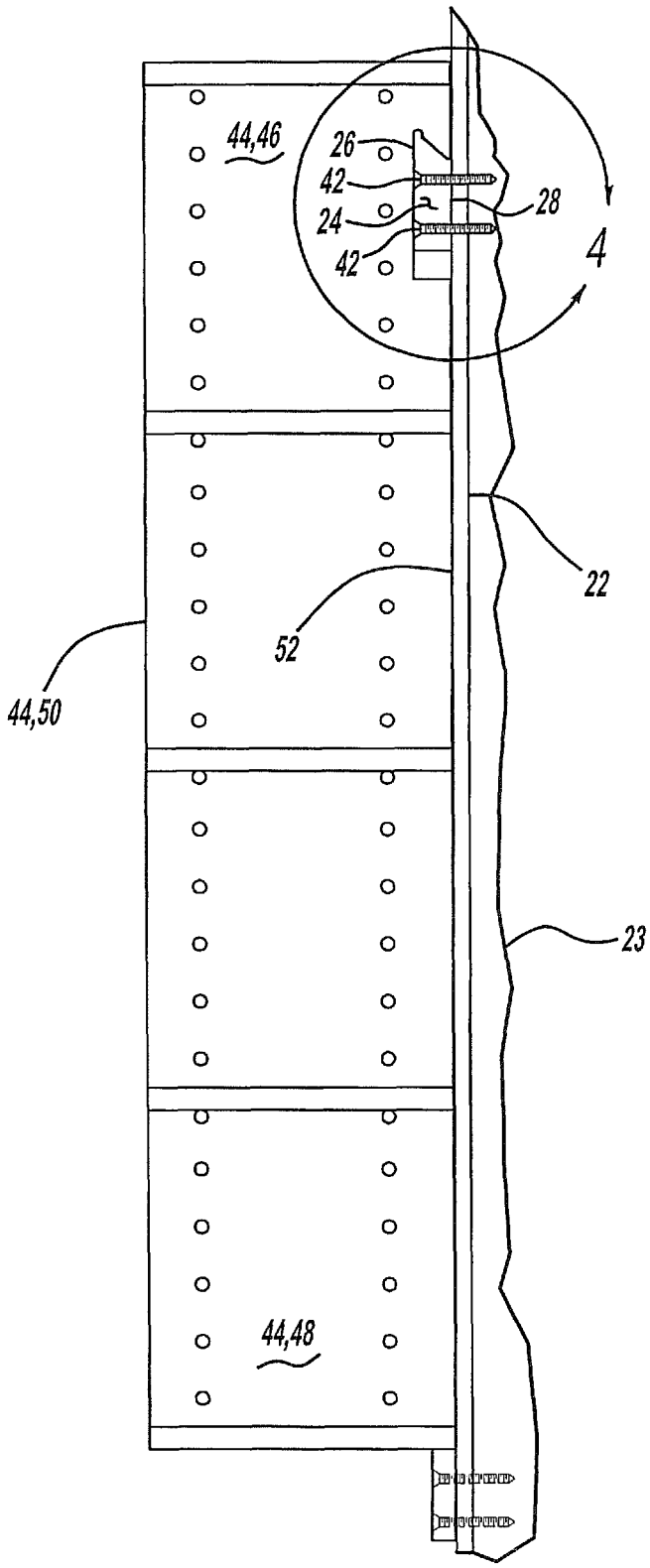
FIG. 3 is a sectional elevation side view of a wall mounted storage system.

The track 24 has a front face 26, a rear face 28, a bottom surface 30 and a top surface 32. The top surface 32 has a front edge 34 and a rear edge 36. The track 24 is formed as a one piece monolithic structure, and as a solid construction extending between the front face 26 and the rear face 28. The front edge 34 of the top surface 32 of the track 24 has a semicircular ridge or radiused edge 38, as shown in FIG. 2. The radiused edge 38 or semicircular ridge includes a first side 38*a* and a second side 38*b* having a curved portion extending therebetween. The first side 38*a* extends linearly from the front face 26 of the track 24. The first side 38*a* extends generally parallel to the second side 38*b* and to the front face 26. The rear edge 36 of the top surface 32 of the track 24 has a flat seat 40, as shown in FIG. 2. The flat seat 40 should be substantially parallel to the bottom surface 30 of the track 24 so that the surface of the flat seat 40 is substantially horizontal when the track 24 is mounted to a wall 22. An intermediate section of the top surface 32 of the track 24 should be provided between the radiused edge 38 and the flat seat 40. The radiused edge 38 of the track 24 and the flat seat 40 extend longitudinally along the top surface 32 of the track 24, as shown in FIG. 2. The flat seat 40 is positioned below the radiused edge 38 when the track 24 is oriented in its wall mount position. The top surface 32 of the track 24 slopes downward from the front face 26 of the track 24 toward the rear face 28 of the track 24.

Figure 4:
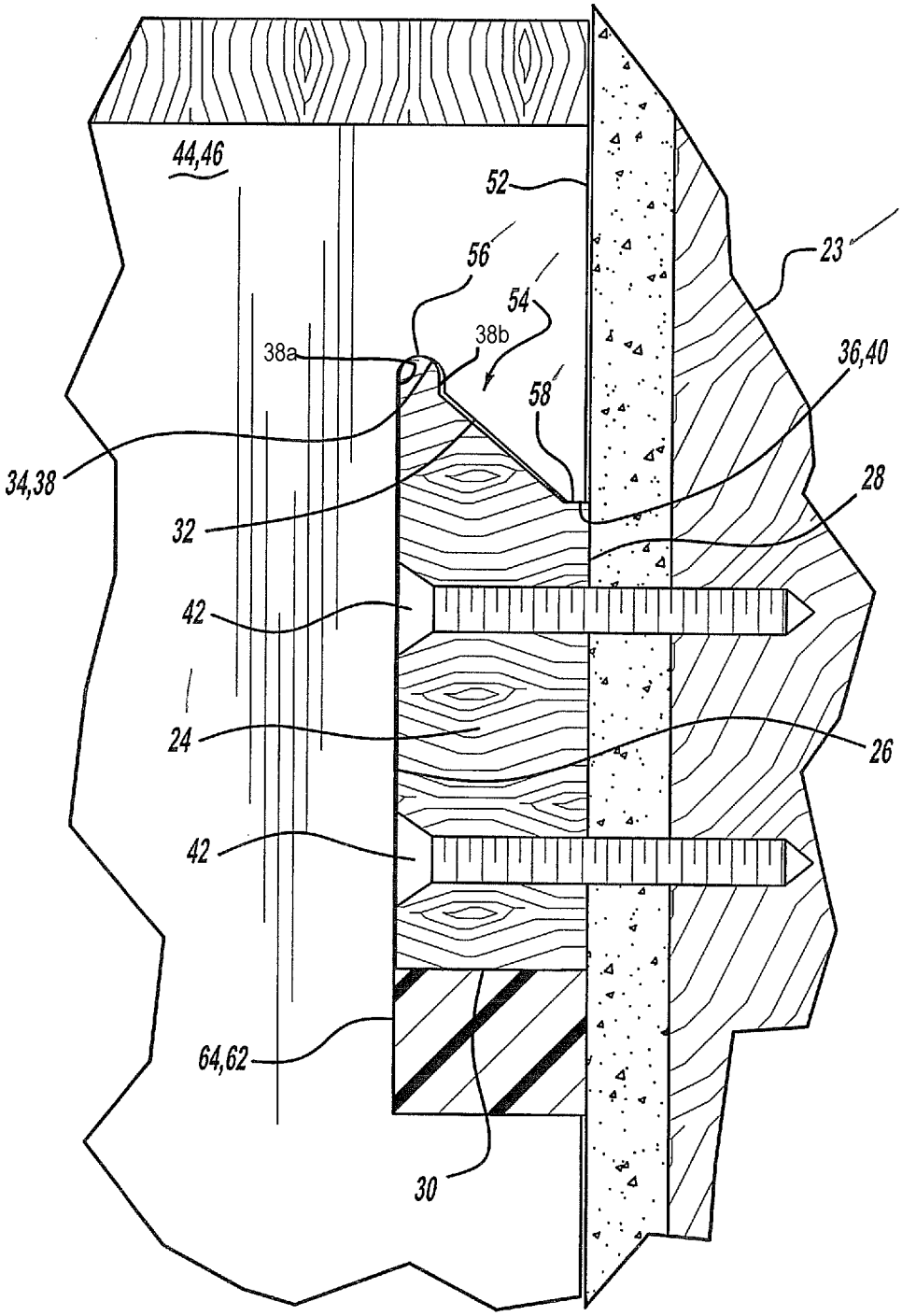
FIG. 4 is a broken away sectional side elevation view of the wall mounted storage system of FIG. 3, showing the configuration of the track, the configuration of the cut out within the vertical panel, the engagement of the cut out of the vertical panel with the track and a plug inserted into the plug opening between the track and the bottom surface of the vertical panel cut out.

The track 24 is horizontally oriented and mounted to a wall 22 at a height from the floor sufficient to allow the track 24 to support the vertical panels 44 by engaging with cutouts 54 provided in the top section 46 of each vertical panel 44. A typical wall 22 consists of wallboard secured to underlying vertical studs 23. The track 24 can be secured to the wall 22 by inserting two screws 42 through the track 24 and each stud 23, as shown in FIG. 4. Again, the track 24 should be so secured to multiple studs 23.

Each vertical panel 44 has a top section 46, a bottom section 48, a front edge 50, a rear edge 52 and a cut out a 54. The references to top, bottom, front and rear are with respect to the position of a vertical panel 44 when it is attached to a track 24 to form a wall mounted storage system 20. The cut out 54 on each vertical panel 44 is positioned within the top section 46 of the vertical panel 44 such that the cut out 54 extends through the rear edge 52 of the vertical panel 44. This is shown in FIG. 4. The cut out 54 is shaped to mate with the track 24. The cut out 54 allows a vertical panel 44 to be securely attached to the track 24.

The rear upper portion of each cut out is configured to have a flat surface 58 which is adapted to contact the flat seat 40 of the track 24 while the front upper portion of cut out 54 is configured to have a radiused section 56 adapted to contact the radiused edge 38 of the track 24. When a vertical panel 44 is mated to the track 24 at the cut out 54 of the vertical panel 44, the flat surface 58 of the cut out 54 is supported by the flat seat 40 of the track 24. The radiused section 56 of the cut out is supported by the radiused edge 38 of the track 24. This allows the radiused edge 38 of the track 24 to support the vertical panel 44 at the radiused section 56 of the cut out 54. The vertical length of the cut out 54 is configured to allow the vertical panel 44 to slide over the track 24 when the vertical panel 44 is being engaged with the track 24 by moving the cut out 54 at the rear edge 52 of the vertical panel 44 from the front face 26 of the track 24 toward the rear face 28 of the track 24. The height of the cut out 54 is further configured such that a plug opening 62 is provided between the bottom surface 30 of the track 24 and the bottom surface 60 of the cut out 54 when the cut out 54 is engaged with the track 24. The plug opening 62 is sized and shaped to receive a plug 64 such that the vertical panel 44 may be locked to the track 24 by preventing vertical movement of the panel 44 with respect to the track 24. Each vertical panel 44 is attached to the track 24 by engaging the cut out 54 of each vertical panel 44 with the track 24.

Preferably, the plug 64 is comprised of a resilient material such as foam or rubber. This will allow the plug 64 to be releasably retained within the plug opening 62. After the vertical panel 44 is installed onto the track 24, the plug 64 is inserted into the plug opening 62, as shown in FIG. 4. The plug 64 is shaped to be press fit within the opening between the bottom surface 30 of the track 24 and the bottom surface 60 of the vertical panel cut out 54. Preferably, the length of the plug 64 is approximately the same length as the width of the vertical panel 44. This will prevent the plug 64 from extending into a storage compartment. This prevents the vertical panel 44 from being inadvertently lifted off of the track 24. Without the plug 64, the vertical panel 44 could be lifted off of the track 24 by someone inadvertently kicking the vertical panel 44, or by contact with a moving object, such as a vacuum cleaner. By fabricating the plug 64 from a resilient material, the plug may be easily installed and removed from the plug opening 62.

Each shelf is 66 is secured to a pair of vertical panels 44. The shelves 66 are horizontally oriented. The vertical panels 44 are vertically oriented. The shelves 66 and the vertical panels 44 form storage compartments, as shown in FIG. 1.

The configuration of the track 24 and the cut out 54 of each vertical panel 44 provides a number of advantages. The vertical panel 44 may be easily installed onto the track 24 by sliding the cut out 54 of the vertical panel 44 over the track 24 such that the cut out 54 of the vertical panel 44 is supported by the track 24, as shown in FIG. 4. The mating surfaces between the cut out 54 and the track 24 cause the vertical panel 44 to be securely attached to the wall mounted storage system 20 even when the track 24 and the cut out 54 are misaligned. Substantial downward forces may be applied to the vertical panel 44 without damaging the vertical panel 44 or the track 24. Also, substantial downward forces can be withstood by the track 24 without the track 24 becoming separated from the wall 22.

Preferably, a bottom protector 70 is attached to the front edge 50 bottom surface of the bottom section 48 of each vertical panel 44. FIGS. 5-12 illustrate the preferred design and use of a bottom protector 70. Typically, in a wall mounted storage system 20, a plurality of vertical panels 44 have their bottom edges resting above floor level. This presents a hazard at the bottom front edge 50 of the vertical panels 44. The bottom front edge 50 corner of the vertical panels can be damaged by a person inadvertently contacting the panel 44, or by an object, such as a vacuum cleaner contacting the vertical panel 44. A person inadvertently contacting an unprotected bottom corner of a vertical panel may be injured. Clothing or other contents stored within the wall mounted storage system 20 may be damaged by contact with the unprotected bottom corner of a vertical panel 44.

The width of the bottom protector 70 is substantially the same as the width of the vertical panel 44 to which the bottom protector 70 is to be attached. The length of the bottom protector 70 is less than the front to back length of the vertical panel 44 to which the bottom protector 70 is to be attached. The bottom protector 70 may be fabricated from plastic, acrylic or other solid or flexible materials. The bottom protector 70 has a top surface and a bottom surface. The top surface of the bottom protector 70 is that surface which is intended to be in contact with the bottom surface of the vertical panel 44 when the bottom protector 70 is attached to the vertical panel 44. The bottom surface of the bottom protector 70 is that surface of the bottom protector which is lowest when the bottom protector 70 is attached to a vertical panel 44. The perimeter of the bottom protector 70 is provided with one or more beveled edges 72, such that the surface area of the bottom surface of the bottom protector 70 is less than the surface area of the top surface of the bottom protector 70, as shown in FIG. 10. The one or more beveled edges 72 of the bottom protector eliminate sharp corners at the bottom front edge 50 of the vertical panels 44. The term beveled edges 72, as used herein, includes radiused edges. The rigidity of the bottom protector 70 protects the bottom front edge 50 corner of the vertical panel 44 from being damaged by physical contact. The one or more beveled edges 72 of the bottom protector 70 reduce the likelihood of a person being injured or property being damaged when it comes into contact with the bottom front edge 50 corner of the vertical panel 44.

Figure 5:
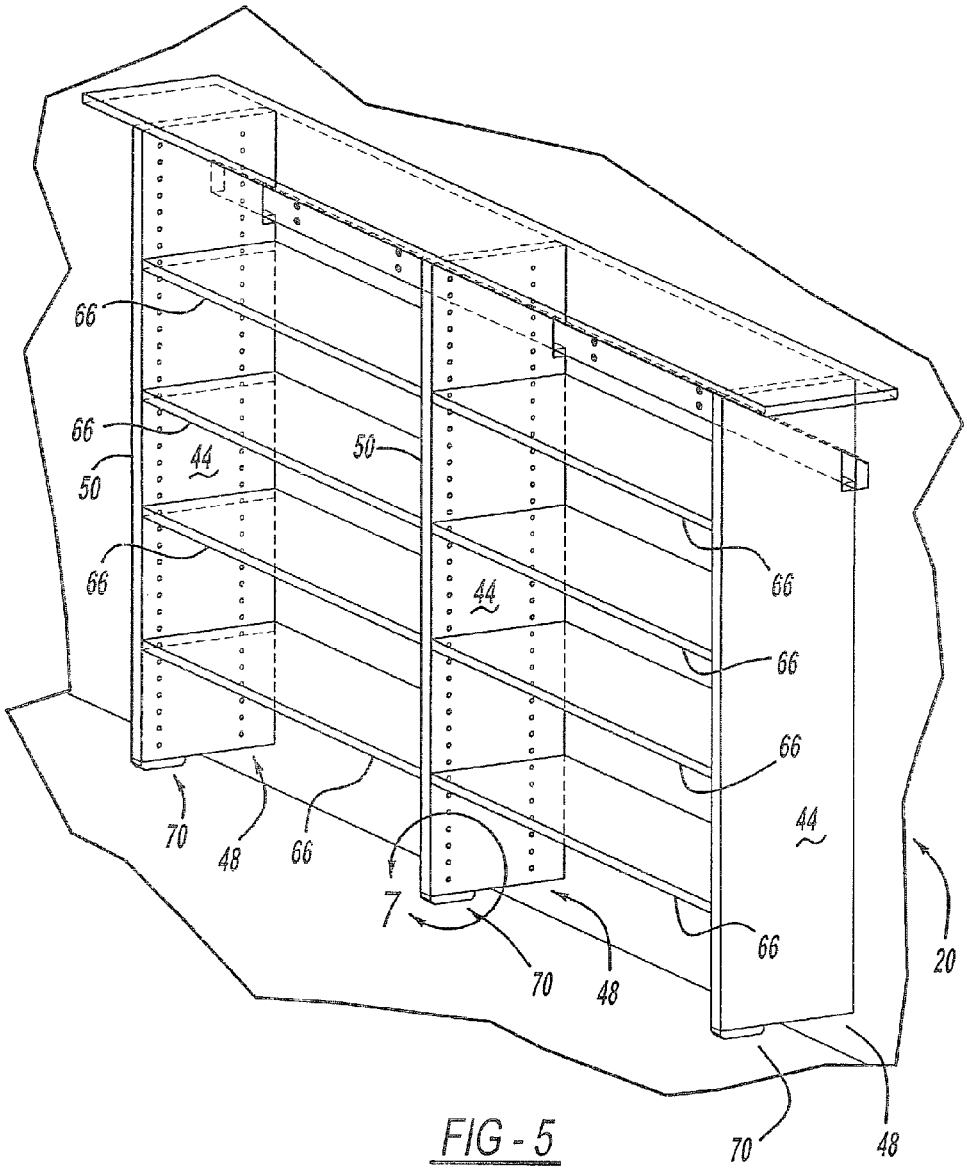
FIG. 5 is a perspective view of a wall mounted storage system showing bottom protectors attached to the bottom front surface of three vertical panels.
Figure 6:
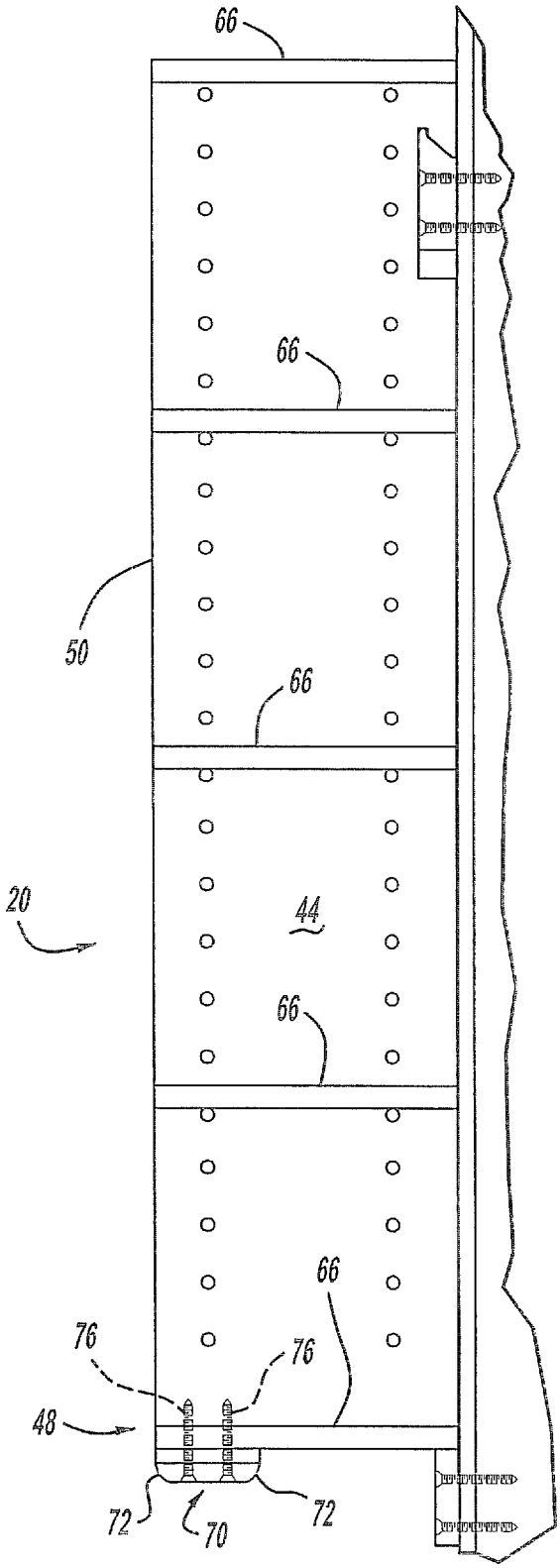
FIG. 6 is a side elevation view of a wall mounted storage system showing a bottom protector attached to the bottom front surface of a vertical panel.
Figure 7:
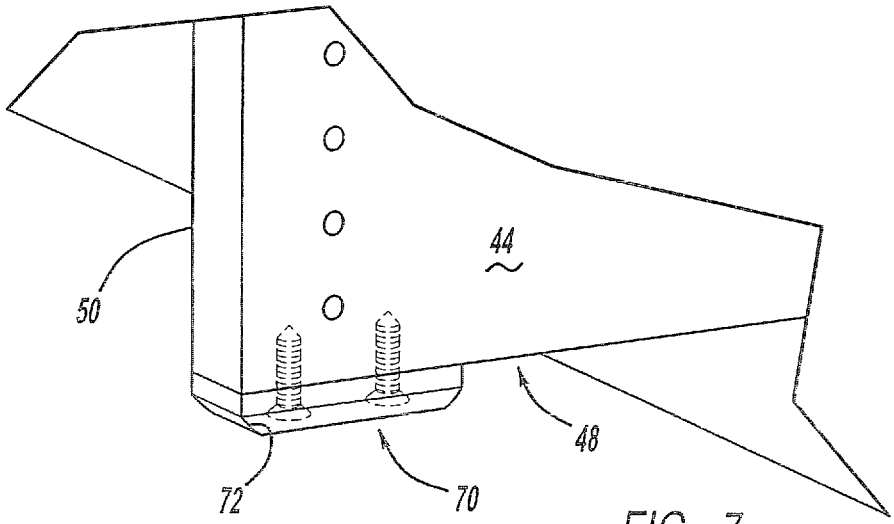
FIG. 7 is a broken away perspective view of a vertical panel of the wall mounted storage system of FIG. 5, showing a bottom protector attached to the bottom front surface of a vertical panel.
Figure 8:
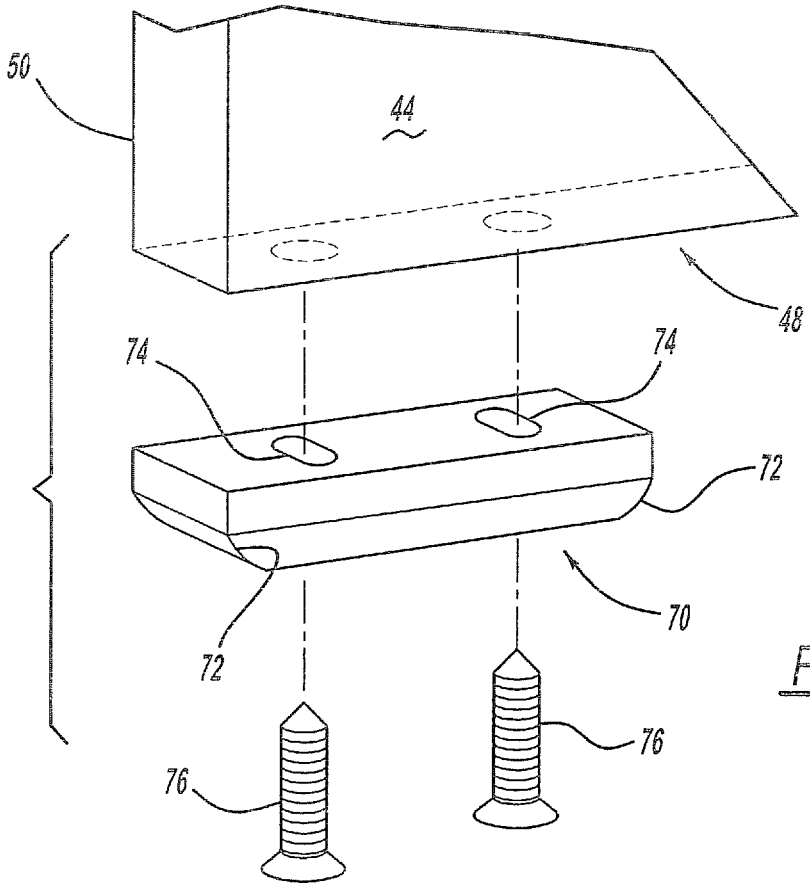
FIG. 8 is an exploded perspective view of the broken away section of FIG. 7, showing the bottom front portion of the vertical panel, the bottom protector and the screw fasteners used to attach the bottom protector to the vertical panel.

In the preferred embodiment of a bottom protector 70, a plurality of fastener openings 74 extend from the bottom surface of the bottom protector 70 to the top surface of the bottom protector 70, as shown in FIG. 9. The fastener openings 74 are countersunk at the bottom surface of the bottom protector 70, as shown in FIGS. 9-12. This allows a screw to be used to fasten the bottom protector 70 to the vertical panel 44 without having the head of the screw protruding from the bottom surface of the bottom protector 70. The bottom protector 70 is attached to the bottom front edge 50 of the vertical panel 44, at the bottom surface of the vertical panel 44, as shown in FIG. 5 and FIG. 6. Preferably, screws 76 are used to attach the bottom protector 70 to the vertical panel.

Although the invention has been shown and described with reference to certain preferred embodiments and methods, those skilled in the art undoubtedly will find alternative embodiments and methods obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A wall mounted storage system for attachment to a wall, said wall mounted storage system comprising:

a track member mounted to the wall, said track member having a front face, a rear face, a bottom surface, and a shaped top surface having an upper front edge connected to said front face and an upper rear edge connected to said rear face, said rear face contacting the wall, said shaped top surface having a longitudinally extending generally semicircular ridge having a first side extending from said upper front edge of said shaped top surface and an opposite second side positioned between said upper front edge and said upper rear edge, said upper rear edge of said track member having a longitudinally extending generally horizontally oriented flat seat, said flat seat extending from said upper rear edge towards said upper front edge, and a sloped portion extending between said second side of said semicircular ridge and said flat seat;

a plurality of vertical panels, each of said vertical panels having a front edge, an opposite rear edge and a cut out extending from said rear edge of said panel, said cut out having a shaped top portion that corresponds to the shaped top surface of the track member, said shaped top portion of said cut out receives said shaped top surface of the track member to support said plurality of vertical panels, said cut out has a height greater than a height of said track member so as to define a plug opening between said bottom surface of said track member and a bottom surface of said cut out; and a plug member having a pair of generally planar opposing sides;

wherein upon engagement of said cut out of said vertical panel with said track member, said rear edge of said vertical panel abuts the wall;

said plug member inserted into said plug opening of said cut out between said bottom surface of said track member and said bottom surface of said cut out, said plug member preventing relative movement between said vertical panel and said track member, said plug member is formed of a resilient material to allow the plug to be releasably retained within said plug opening, each of said pair of sides positioned adjacent to one of said bottom surface of said track member and said bottom portion of said cut out when said plug member is received within said plug opening.

2. The wall mounted storage system of claim 1, wherein said shaped top portion of said cut out includes an upper front side and an upper rear side, said upper rear side adjacent said rear edge of said vertical panel, said upper rear side having a generally horizontally oriented flat portion that corresponds to said flat seat of said track member, said flat portion of said cut out rests on said flat seat of said track member to support said vertical panel.

3. The wall mounted storage system of claim 1, wherein said sloped portion of said shaped top surface of said track member slopes downward from said second side of said semicircular ridge to said flat seat, and wherein said shaped top portion of said cut out includes a corresponding sloped portion to said shaped top surface of said track member.

4. The wall mounted storage system of claim 3, wherein said upper front edge is positioned above said upper rear edge.

5. The wall mounted storage system of claim 1, wherein said track member is mounted to the wall by at least one fastener so as to support said plurality of vertical panels while preventing bending of said track member.

6. The wall mounted storage system of claim 1, further comprising:

a bottom protector attached to each of said plurality of vertical panels, said bottom protector having a width substantially the same as a thickness of said vertical panels, said bottom protector having a length less than a front to rear depth width of said vertical panels, said bottom protector having a top surface and a bottom surface, wherein a perimeter of said bottom protector between said top surface and said bottom surface of said bottom protector is beveled and wherein said bottom protector is attached to an underside of said vertical panels at said front edge.

7. A wall mounted storage system for attachment to a wall, said wall mounted storage system comprising:

a track member mounted to the wall, said track member having a front face, a rear face, a bottom surface, and a shaped top surface, said rear face contacting the wall, said shaped top surface having a longitudinally extending generally semicircular upper front edge and a generally longitudinally extending horizontally oriented flat upper rear edge, said shaped top surface having a sloped portion that extends between said semicircular upper front edge and said flat upper rear edge;

a plurality of vertical panels, each of said vertical panels having a front edge, a rear edge and a cut out extending from said rear edge of said panel, said cut out having a shaped top portion that corresponds to said shaped top surface of said track member, said shaped top portion of said cut out receives said shaped top surface of said track member to support said plurality of vertical panels, said shaped top portion of said cut out includes an upper front side and an upper rear side, said upper rear side adjacent said rear edge of said vertical panel, said upper rear side having a generally horizontally oriented flat portion that corresponds to said flat upper rear edge of said track member, said flat portion of said cut out rests on said flat upper rear edge of said track member, said upper front side of said shaped top portion of said cut out has a shape corresponding to said semicircular upper front edge of said track member, said shaped top portion of said cut out includes a corresponding slope to said sloped portion of said track member, said cut out has a height greater than a height of said track member from said semicircular front edge to said bottom surface so as to define a plug opening; and a plug member having a pair of generally planar opposing sides;

wherein upon engagement of said cut out of said vertical panel with said track member, said rear edge of said vertical panel abuts the wall;

said plug member inserted into said cut out between said bottom surface of said track member and a bottom surface of said cut out, said plug member preventing relative movement between said vertical panel and said track member, said plug member is formed of a resilient material to allow the plug to be releasably retained within said plug opening, each of said pair of sides positioned adjacent to one of said bottom surface of said track member and said bottom portion of said cut out when said plug member is received within said plug opening.

8. The wall mounted storage system of claim 7, wherein said semicircular upper front edge of said shaped top surface is positioned above said flat upper rear edge of said shaped top surface.

9. The wall mounted storage system of claim 7, wherein said track member is mounted to the wall by at least one fastener so as to support said plurality of vertical panels while preventing bending of said track member.

10. The wall mounted storage system of claim 7, further comprising:

a bottom protector attached to each of said plurality of vertical panels, said bottom protector having a width substantially the same as a thickness of said vertical panels, said bottom protector having a length less than a front to rear depth width of said vertical panels, said bottom protector having a top surface and a bottom surface, wherein a perimeter of said bottom protector between said top surface and said bottom surface of said bottom protector is beveled and wherein said bottom protector is attached to an underside of said vertical panels at said front edge.

11. A wall mounted storage system for attachment to a wall, said wall mounted storage system comprising:

a track member mounted to the wall, the track member having a front face, a rear face, a bottom surface, and a shaped top surface, the rear face contacting the wall, said shaped top surface of the track member slopes downward from said front face of said track member toward said rear face of said track member;

a plurality of vertical panels, each of said vertical panels having a front edge, a rear edge and a cut out extending from said rear edge of said panel, said cut out having a shaped top portion that corresponds to the shaped top surface of the track member, said shaped top portion of said cut out receives said shaped top surface of the track member to support said plurality of vertical panels, said cut out has a height greater than a height of said track member so as to define a plug opening between said bottom surface of said track member and a bottom portion of said cut out; and a plug member inserted into said plug opening of said cut out between said bottom surface of said track member and said bottom portion of said cut out, said plug member preventing relative movement between said vertical panels and said track member, said plug member having a pair of generally planar opposing sides, each of said pair of sides positioned adjacent to one of said bottom surface of said track member and said bottom portion of said cut out when said plug member is received within said plug opening, wherein said plug member is formed of a resilient material to allow the plus to be releasably retained within said plug opening.

12. The wall mounted storage system of claim 11, further comprising:

a bottom protector attached to each of said plurality of vertical panels, said bottom protector having a width substantially the same as a thickness of said vertical panels, said bottom protector having a length less than a front to rear depth width of said vertical panels, said bottom protector having a top surface and a bottom surface, wherein a perimeter of said bottom protector between said top surface and said bottom surface of said bottom protector is beveled and wherein said bottom protector is attached to an underside of said vertical panels at said front edge.

* * * * *